United States Patent [19]

Ohno et al.

[11] Patent Number: 4,985,075

[45] Date of Patent: Jan. 15, 1991

[54] METHOD FOR MANUFACTURING CHROMIUM-BEARING PIG IRON

[75] Inventors: Yotaro Ohno; Masahiro Matsuura; Kenkichi Sato; Hiroshi Fukuyo, all of Tokyo, Japan

[73] Assignee: Nippon Kokan Kabushiki Kaisha, Tokyo, Japan

[21] Appl. No.: 296,873

[22] Filed: Jan. 12, 1989

Related U.S. Application Data

[63] Continuation of Ser. No. 36,565, Apr. 9, 1987, abandoned.

[30] Foreign Application Priority Data

Jun. 10, 1986 [JP] Japan ..... 61-134622

[51] Int. Cl.[5] ..... C21B 5/02

[52] U.S. Cl. ..... 75/460; 75/463; 75/466; 420/34; 420/428; 420/583

[58] Field of Search ..... 75/3, 41, 42, 84, 257, 75/460, 463, 464, 466; 420/34, 104, 428, 583

[56] References Cited

U.S. PATENT DOCUMENTS

| | | | |
|---|---|---|---|
| 3,460,934 | 8/1969 | Kelmar | 75/41 |
| 3,661,555 | 5/1972 | Kusuma et al. | 75/3 |
| 4,106,929 | 8/1978 | Saito et al. | 75/3 |
| 4,198,228 | 4/1980 | Jordan | 75/42 |
| 4,381,938 | 5/1983 | Claflin | 75/42 |
| 4,412,862 | 11/1983 | Miyashita et al. | 420/428 |
| 4,723,995 | 2/1988 | Satomi et al. | 75/3 |

FOREIGN PATENT DOCUMENTS

| | | | |
|---|---|---|---|
| 443575 | of 1923 | Australia . | |
| 428742 | 5/1926 | Fed. Rep. of Germany . | |
| 588559 | 11/1951 | Fed. Rep. of Germany . | |
| 2261766 | 6/1974 | Fed. Rep. of Germany . | |
| 2754988 | 6/1978 | Fed. Rep. of Germany | 75/3 |
| 60-21218 | 5/1985 | Japan . | |

OTHER PUBLICATIONS

Dean, Eugene R., "Utilization of Fuel Gas by Injection Through Blast Furnace Tuyeres", *Blast Furnace and Steel Plant,* May 1961, pp. 417–422.

Manufacture of Stainless Steel in the Top-Blown Oxygen Converter by F. C. Langenberg, C. W. McCoy & E. L. Kern disclosed in publication, "*Blast Furnace and Steel Plant*", dated Aug., 1967.

*Primary Examiner*—Theodore Morris
*Assistant Examiner*—George Wyszomierski
*Attorney, Agent, or Firm*—Frishauf, Holtz, Goodman & Woodward

[57] ABSTRACT

A method for manufacturing a chromium-bearing pig iron comprises the steps of charging cold bond pellets, iron ore and coke lumps into a blast furnace from above and blowing a gas containing more than 50% oxygen therein and tuyere nose flame temperature control agent into the blast furnace through the tuyere, the cold bond pellets being comprised of powdered chromium ore and powdered coke as principal feed materials. The cold bond pellets are manufactured by performing a mixing, a pelletizing and a curing step. The tuyere nose flame temperature control agent is a top gas, steam, water or $CO_2$, which is used to control the flame temperature to 2000° to 2900° C.

17 Claims, 7 Drawing Sheets

METHOD FOR MANUFACTURING CHROMIUM-BEARING PIG IRON

This application is a continuation of application Ser. No. 07/036,565, filed Apr. 9, 1987.

BACKGROUND OF THE INVENTION

1. Field of the Invention

This invention relates to a method for manufacturing chromium-bearing pig iron with the use of a blast furnace and, in particular, a method for manufacturing chromium-bearing pig iron, by using -cold bond pellets as a burden with a gas blast from a tuyere in the blast furnace.

2. Description of the Prior Art

Chromium-bearing pig iron is generally manufactured in an electric furnace. Several proposals have been made to manufacture chromium-bearing pig iron in a blast furnace, but are not reduced to actual practices, in spite of being tested in the blast furnace, due to the fact that chromium ore is difficult to reduce and high in its melting point.

Japanese Patent Publication (KOKOKU) No. 60-21218 discloses:

(1) the use of cold bond pellets contained carbon material; and (2) the use of a high flame temperature at a tuyere nose which is attained by blowing a hot stream of oxygen-enriched air from the tuyere, the air containing oxygen of 41% or less.

This method has the drawbacks in that a quantity of gas passing through the bosh section is so great that a top gas temperature is high on the order of over 500° C.; this gives a heavy load on the furnace top equipment and involves the low productivity.

SUMMARY OF THE INVENTION

The object of this invention is to provide a method for manufacturing chromium-bearing pig iron, which prevents a rise in temperature prevalent at the upper portion of a blast furnace, and can alleviate thermal heat on the body of the blast furnace and on the furnace equipment.

These and the other objects, as well as the advantages, will become more evident from the following detailed explanation of this invention in conjunction with the accompanying drawings.

According to this invention a method for manufacturing chromium-bearing pig iron is provided which comprises the steps of:

introducing cold bond pellets prepared from powdered chrome ore and powdered coke, iron ore and coke lumps into a blast furnace; and blowing a gas containing more than 50% oxygen, into the blast furnace, through a tuyere therein.

DETAILED DESCRIPTION OF THE PREFERRED EMBODIMENTS

Figure 1:
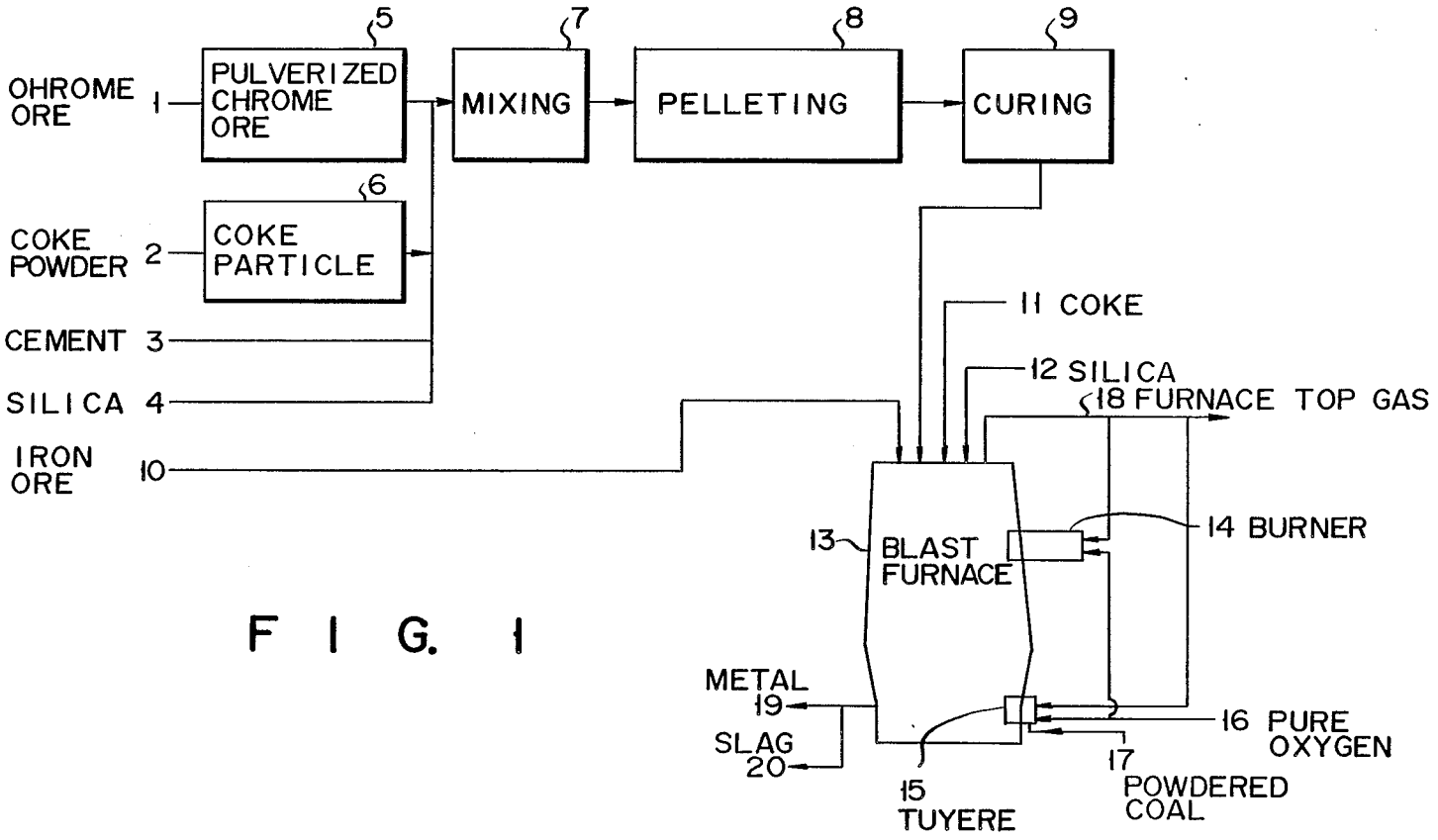
FIG. 1 is an explanatory view showing a blast furnace operation according to one embodiment of this invention.

FIG. 1 is a diagrammatic view showing, by way of example, a method for manufacturing chromium-bearing pig iron according to this invention.

Powdered chromium ore 5 prepared from chromium ore 1 by fine-pulverizing, powdered coke 6 prepared from coke fine 6 by coarse-pulverizing, cement 3 and powdered silica stone 4 are made into a mixture by mixing 7. The mixture is agglomerated into green pellets by pelleting 8. The green pellets are formed into cold bond pellets, by curing 9.

The cold bond pellets, iron ore 10, coke 11 and silica stone 12 are charged into blast furnace 13.

Top gas 18 and pure oxygen 16 are burned by burner 14 and the burned gas is blown into the burden at a middle level of the blast furnace so that the preheating step is carried out. Pure oxygen 16, pulverized coal 17 and top gas as tuyere nose flame temperature control agent 18 are blown into the blast furnace through tuyere 15. By this method the reduction reaction of the ore progresses to yield chromium-bearing pig iron 19 and slag 20 at the furnace hearth section.

The term "pure oxygen" appearing in the specification and claims of this invention is intended to mean that it is not necessarily 100% in purity and may contain a small amount of impurity.

According to this method, since the cold bond pellets are provided as cold bond pellets contained carbon material, the ore particles are small in size and thus have many points of contact with the carbon particles, allowing the reduction reaction to progress at a low temperature and thus contributing to the reduction of a heat load on the furnace body. At 1350° C., for example, a 90% reduction is achieved for 60 minutes in which case the reduction speed of the ore, if the particle size is smaller, progesses generally rapidly since the particle size determines the rate of diffusion in the ore. The reduction speed becomes greater with an increasing amount of carbon contained, but no appreciable effect is revealed even if the amount of carbon to be added exceeds an equivalent value for the generation of carbide. Because the powdered silica stone is added in the preparation of the cold bond pellets it is possible to obtain the pellets excellent not only in the reduction property but also in the softening and melting property at high temperature. Curing 9 is classified into two types: (1) an "as-cured" type and (2) a rapid curing. In this type (1) the pellets are allowed to be cured in the air atmosphere for 3 to 4 weeks to improve the strength. In the type (2) the pellets are subjected to a pre-drying, steam treating and post-drying process at 9 to 14 hours to improve the strength At such curing step it is possible to obtain the strength required as the burden for the blast furnace.

Where an intended chromium content is less than 40%, the operation can be carried out. In such case a necessary heat quantity is not obtained due to an excessively smaller quantity of gas at the bosh section. It is, therefore, preferable to obtain a necessary temperature level by blowing a preheating gas from the middle level of the blast furnace. However, even in the case of the less than 40% chromium content, if the operation is carried out by means of raising a fuel ratio thereby to increase the quantity of the gas at the bosh section, it is possible to obtain a necessary heat quantity to preheat a burden.

Although according to this embodiment, as the preheating gas, use is made of a burnt gas of top gas 18 and pure oxygen 16 which are introduced into the blast furnace through burner 14, use may be made of, in addition to the top gas, a coke oven gas, heavy oil and tar oil. Although the burner is used according to this invention, a preheating gas may be produced with the use of a combustion furnace. The temperature of the preheating gas is set properly within a range of 1000° C. to 1600° C. At less than 1000° C. the reduction reaction of the cold bond pellet is slowed down. At a temperature exceeding 1600° C., the ore is softened, resulting in an unsatisfactory "descending" behavior. The temperature exceeding 1600° C. increases a heat load on the furnace and shortens a service life thereof. Where the chromium contents are high, on the order of over 40%, the fuel ratio becomes higher and the quantity of bosh gas is increased, thus obviating the necessity of using the preheating gas.

Pure oxygen 16 and flame temperature control agent are blown into the furnace through tuyere 15. The flame temperature control agent is preferably a top gas, steam, water, $CO_2$ and cold air and it is better to control the flame temperature to 2000° to 2900° C. At less than 2000° C., it is difficult to hold the temperature of the chromium-bearing pig iron at a level at which an adequate tapping can be carried out. At a temperature exceeding 2900° C., the gasification of slag components occurs violently, causing the condensation of the resultant gas in the upper part of the furnace and the consequent occurrence of a hanging a temperature in the range of 2400° to 2800° C. is optimum.

Furthermore, since oxygen is blown through the tuyere into the furnace in place of hot air, a greater quantity of fuel can be blown there, thus reducing an amount of coke expended. As the fuel, use is made of pulverized coal, pulverized coke, heavy oil and tar oil.

Moreover, the gas amount is lowered at the bosh section owing to the blowing of the oxygen, thus preventing a temperature rise in the top zone of the furnace and an attendant "floating" of the burden. As a result, it is possible to obtain an improved production. The top gas finds a wider availability as a synthetic chemical feed gas since it substantially never contains $N_2$.

In this embodiment, since pure oxygen 16 is blown through tuyere 15, the pure oxygen can be substituted for by the gas containing oxygen of more than 50%. If the oxygen content is 50% or less, it is necessary to raise a fuel ratio. This results in raising top gas temperature excessively and undesirably. It is preferable that the oxygen content be 95 to 100%. The content range has the advantages in that, (a) The effective constituent ($CO+H_2$) contained in the gas generated at the tuyere nose set in a blast furnace is increased.

(b) The gas amount per production unit can be reduced, so productivity is improved.

(c) The furnace top gas is suitable for synthetic chemical feed gas, since the gas is abundant in CO, almost free from $N_2$.

As to slag composition, it is preferable that $Al_2O_3$-MgO contained in the slag is 30% or less. If the content exceeds 30%, the reduction of $Cr_2O_3$ remaining in the hearth section proceeds slower and the yield rate of chromium is deteriorated. In this embodiment, silica stone is used as a flux for controlling slag composition.

This invention will better be understood from the following examples, noting that these examples are by way of explanation and should not be taken as being restrictive.

The balance of material and of heat in the operation of the furnace will be explained below to reveal the oxygen and the hot air operation.

Table 1 shows the computational requirements.

The material balance is taken for upper and lower sections, i.e., two sections of the blast furnace. The interface temperature of the upper and lower sections is made equal to a temperature at which the direct reduction reaction of $Cr_2O_3$ for controlling a heat balance at the lower section of the blast furnace starts, that is, 1650° C. and 1350° C. are used for lumps chrome ore and cold bond pellets contained carbon material, respectively. A quantity of preheating gas and quantity of gas blown through tuyere are determined from the balances of the upper and lower sections, respectively, of the blast furnace.

TABLE 1-1

① Ore composition

| | TFe | FeO | Fe | $Cr_2O_3$ | $SiO_2$ | CaO | $Al_2O_3$ | MgO | Mn |
|---|---|---|---|---|---|---|---|---|---|
| Fe ore | 0.5863 | 0.0395 | 0 | 0 | 0.0540 | 0.0800 | 0.0153 | 0.0129 | 0.0030 |
| Cr ore | 0.1127 | 0.145 | 0 | 0.564 | 0.0455 | 0.0043 | 0.1290 | 0.1302 | 0 |

② Pig iron composition

| No. | Cr | C | Si | P | Fe |
|---|---|---|---|---|---|
| 1 | 60 | 8 | 1 | 0.05 | 30.95% |
| 2 | 40 | 8 | 1 | 0.05 | 50.95 |
| 3 | 20 | 8 | 1 | 0.05 | 70.95 |
| 4 | 10 | 8 | 1 | 0.05 | 80.95 |

③ Slag composition $CaO/SiO_2 = 0.5$ $(Al_2O_3 + MgO)/(Al_2O_3 + MgO + SiO_2 + CaO) = 0.42$

TABLE 1-2

④ Temperature of molten metal and molten slag

Molten metal 1750° C.

Molten slag 1800° C.

⑤ Solid temperature $T_R$ at the interface between the upper and lower sections

Cold bond pellet contained carbon material: $T_R$ 1350° C.

Ore lump: $T_R$ 1650° C.

TABLE 1-2-continued

⑥ Heat loss $25 \times 10^4$ Kcal/T

⑦ Gas blowing conditions

| Gas blowing | Controlling agent | Blowing temperature | Flame temperature |
|---|---|---|---|
| Hot air ($O_2$ 21%) | | 600° C. | 2000° C. |
| Hot air ($O_2$ 21%) | | 900 | 2300 |
| Hot air ($O_2$ 30%) | | 1100 | 2600 |
| $O_2$ | top gas | — | 2600, 2900 |
| $O_2$ | steam | — | 2600, 2900 |

TABLE 1-3

| | | ⑧ Amount of charge (Kg/T) | | | |
|---|---|---|---|---|---|
| No. | Cr % in pig iron | Cr ore | Fe ore | Limestone | Silica stone |
| 1 | 60 | 1690 | 209 | 350 | 295 |
| 2 | 40 | 1126 | 662 | 130 | 130 |
| 3 | 20 | 564 | 1115 | 0 | 60 |
| 4 | 10 | 282 | 1340 | | |

Figure 2:
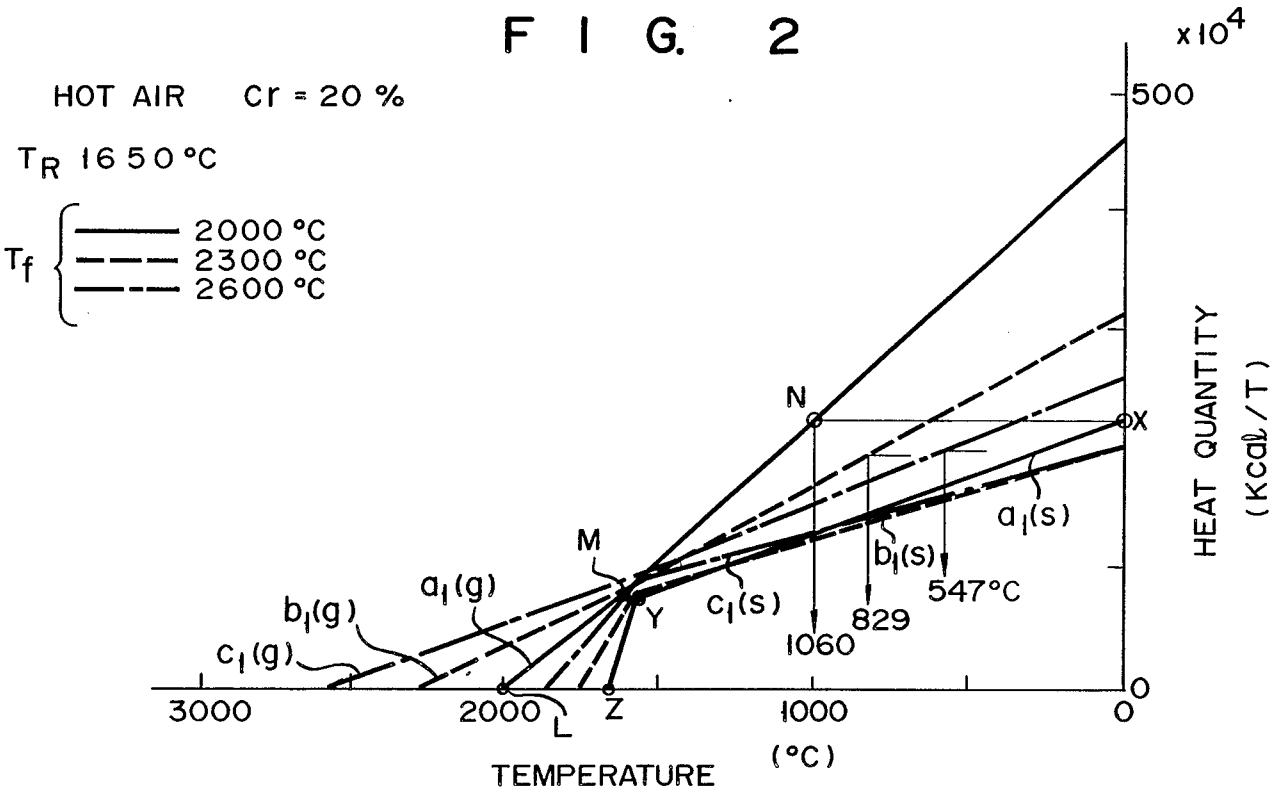
FIG. 2 is a view showing a heat balance during a hot air operation as in Control.
Figure 3:
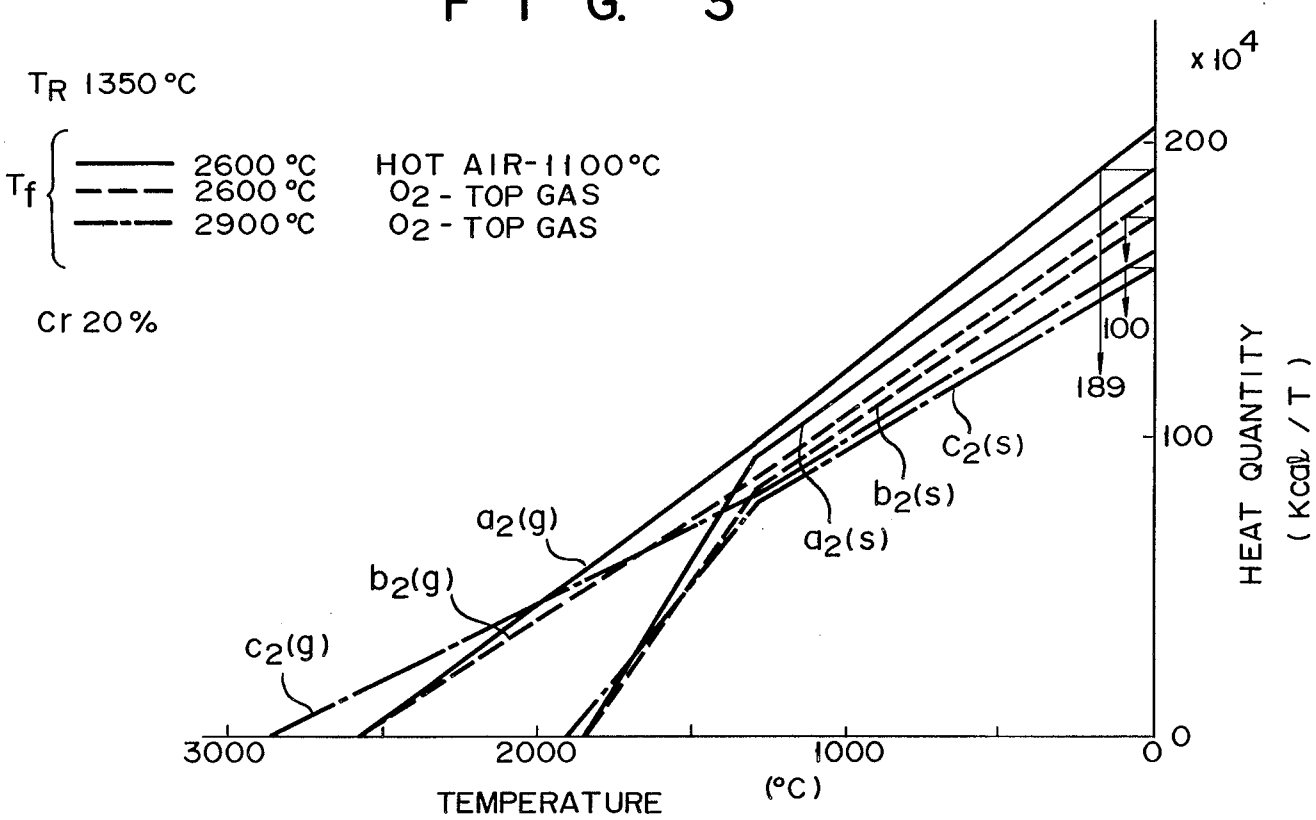
FIG. 3 is a view showing a heat balance in an embodiment of this invention when a flame temperature at the tuyere nose is varied.
Figure 4:
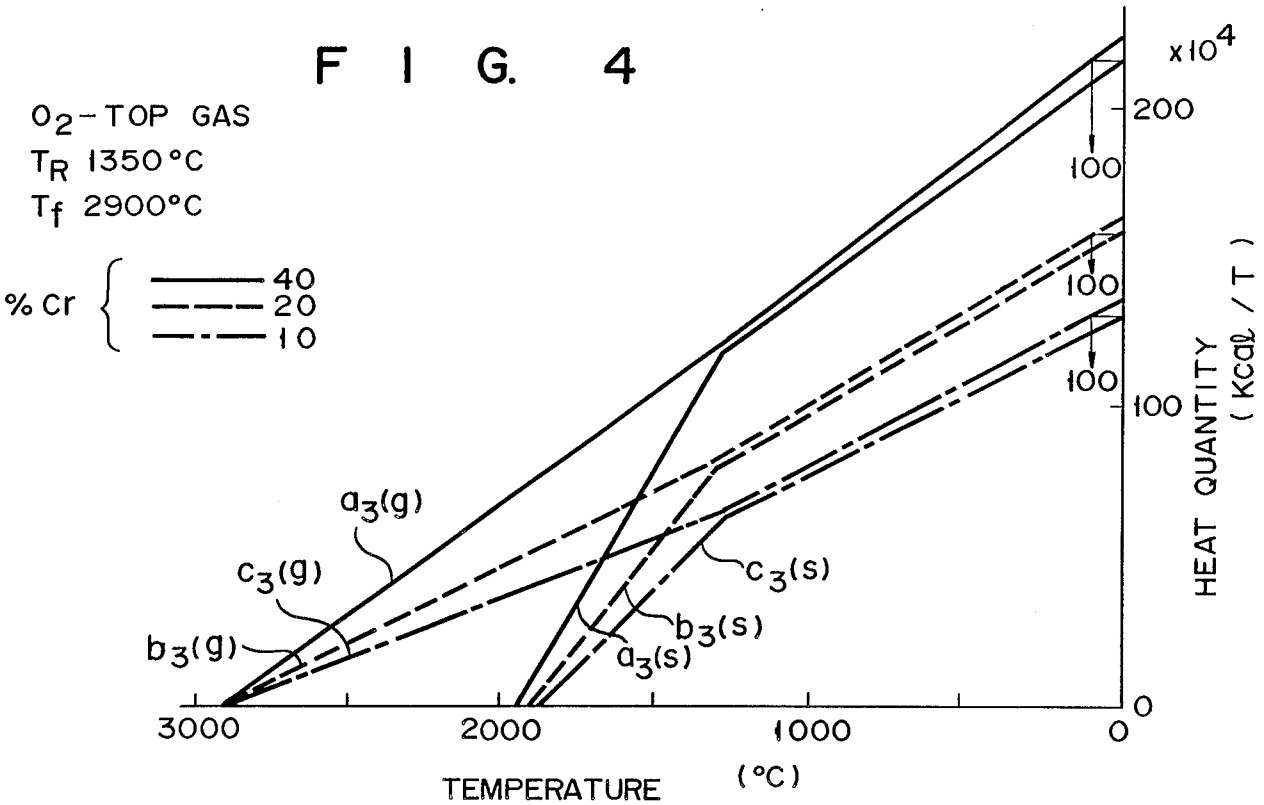
FIG. 4 is a view showing a heat balance in another embodiment of this invention when the chromium content in pig iron is varied.

The results of computations are shown in FIGS. 2 to 4.

These Figures each show a relation of a heat quantity necessary for raising the temperature of a solid and for the reduction reaction in the furnace operation to a heat quantity radiated coincident with the lowering of the gas temperature. In FIGS. 2 to 4, the greater the slopes of lines showing the relation of the temperature at the gas to the heat quantity, the greater the quantity of bosh gas and the higher the fuel ratio.

FIG. 2 is a computational example for the hot air operation of Control in which case tuyere nose flame temperature is varied as a $Cr_2O_3$ reduction reaction initiation temperature of 1650° C. and at a Cr concentration level of 20%. The temperature of 1650° C. is so set due to the use of chromium ore lumps.

In the graphical representation of FIG. 2, the temperature variation of the solid at the tuyere nose flame temperature ($T_f$) of 2000° C. is represented as $a_1(S)$ with the temperature variation of the gas represented by $a_1(g)$, the temperature variation of the solid at the temperature ($T_f$) of 2300° C. as $b_1(S)$ with the temperature variation of the gas represented by $b_1(g)$, and the temperature variation of the solid at the temperature ($T_f$) of 2600° C. as $C_1(S)$ with the temperature variation of the gas represented by $C_1(g)$. At the tuyere nose flame temperature of 2000° C., for example, the temperature of the solid varies along the $a_1(S)$ line of X→Y→Z, where X: the top charging state Y: the state at the interface between the upper and lower sections; and Z: the tapping state.

The gas temperature varies along the $a_1(g)$ line of L→M→N, where

L: the state at the tuyere nose;

M: the state at the interface between the upper and lower sections; and

N: the state of the gas discharged from the furnace top.

By raising the tuyere nose flame temperature $T_f$ the fuel ratio F.R. is lowered and the top gas temperature is greatly lowered from 1060° to 547° C. At the respective tuyere nose flame temperature, however, the top gas temperature is high, on the order of over 500° C., thus presenting the problems of an injury to the refractories at the furnace top and a heat load on the equipment at the top of the furnace.

FIG. 3 shows the variation of the furnace operation at a constant Cr content level of 20% when hot air or pure oxygen is blown into the furnace through the tuyere. Since use is made of a cold bond pellets contained carbon material, the temperature at which the reduction reaction of $Cr_2O_3$ is initiated is 1350° C. In the hot air blast operation the tuyere nose flame temperature is 2600° C. at the hot air temperature of 1100° C., noting that the variation of the temperature of the solid is indicated by $a_2(S)$ and that the variation of the gas temperature is indicated by $a_2(g)$.

In the oxygen blast operation, pure oxygen and top gas as the tuyere nose flame temperature control agent were blown into the furnace through the tuyere to make the flame temperature ($T_f$) at 2600° C. and 2900° C. At $T_f$=2600° C. the temperature variations of the solid and gas are indicated by $b_2(S)$ and $b_2(g)$, respectively, and at $T_f$=2900° C. the temperature variations of the solid and gas are indicated by $C_2(S)$ and $C_2(g)$, respectively. In the case of the oxygen blast operation the top gas temperature is lowered, preheating gas being employed preferably.

FIG. 4 shows a variation in the furnace operation when, in the oxygen blast operation, the Cr content level is varied at $T_R$=1350° C. and $T_f$=2900° C., noting that $T_R$ and $T_f$ represent the $Cr_2O_3$ reduction reaction initiation temperature and tuyere nose flame temperature, respectively. The temperature variations of a 40%-Cr solid and gas are represented by $a_3(S)$ and $a_3(g)$, respectively; the temperature variations of a 20%-Cr solid and gas are represented by $b_3(S)$ and $b_3(g)$, respectively, and the temperature variations of a 10%-Cr solid and gas are represented by $C_3(S)$ and $C_3(g)$, respectively. In the case of the 10%- and 20%-Cr bearing solid the top gas temperature is lowered, a preheating gas being preferably employed. In the case of the 40%-Cr the operation can be carried out without the preheating gas.

As the content (%) of the chromium is increased, the heat quantity required at the lower portion of the furnace is increased, resulting in an increase in the fuel ratio FR.

Figure 5:
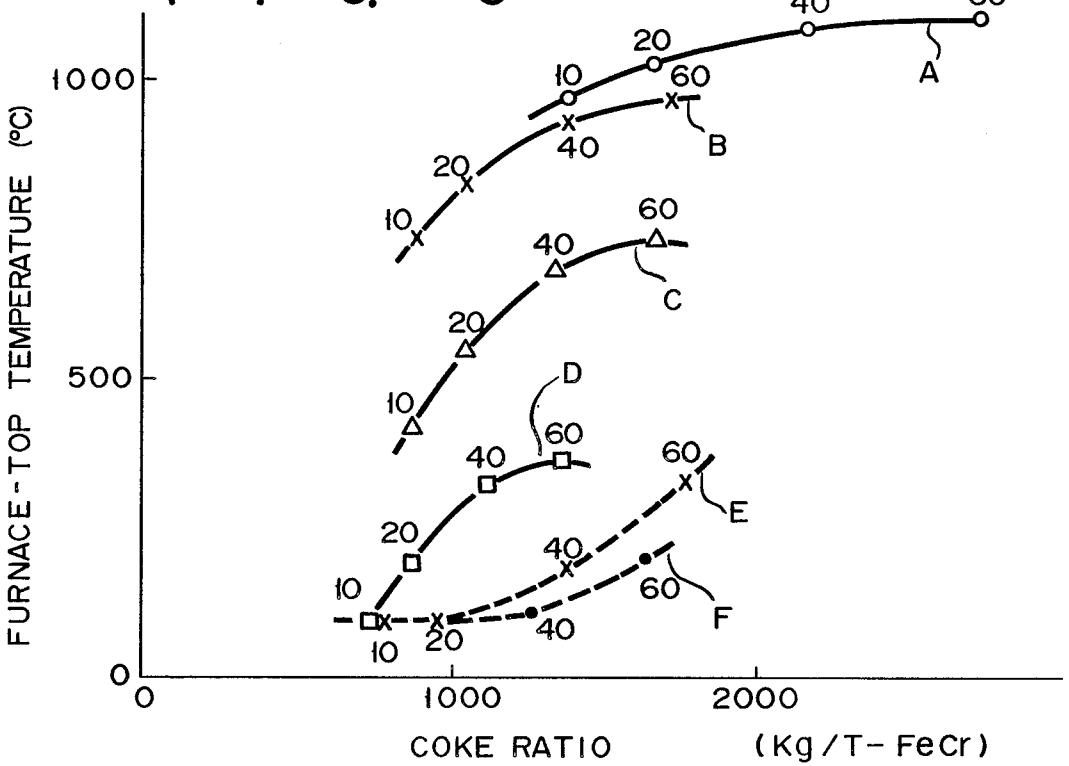
FIG. 5 is a view showing a top gas temperature to coke ratio relation in an oxygen blast furnace in this invention in comparison with that in the hot air operation.

FIG. 5 shows a top gas temperature to coke ratio relation in the oxygen blast operation in comparison with the hot air blast operation. In FIG. 5, 10, 20, 40 and 60 show the contents of chromium in percentage and A, B, C, D, E and F show the computation levels which are shown as the furnace operation requirements in Table 2 below.

TABLE 2

| Level | Blast from tuyere | Blast temp. (°C.) | Tuyere nose flame temp. (°C.) | Reduction reaction initiation temp. (°C.) |
|---|---|---|---|---|
| A | Hot air $O_2$ 21% | 600 | 2000 | 1650 |
| B | Hot air $O_2$ 21% | 900 | 2300 | 1650 |
| C | Hot air $O_2$ 30% | 1100 | 2600 | 1650 |
| D | Hot air $O_2$ 30% | 1100 | 2600 | 1350 |
| E | Pure $O_2$ + Pulverized coal + Top gas | ambient temp. | 2600 | 1350 |
| F | Pure $O_2$ + Pulverized | ambient temp. | 2900 | 1350 |

TABLE 2-continued

| Level | Blast from tuyere | Blast temp. (°C.) | Tuyere nose flame temp. (°C.) | Reduction reaction initiation temp. (°C.) |
|---|---|---|---|---|
| | coal + Top gas | | | |

In the hot air blast operation under the various conditions as indicated by the solid lines in FIG. 5, when the chromium content is increased, the top gas temperature is increased so that the furnace operation becomes difficult. In the oxygen blast operation (E, F), according to this invention as indicated by the broken lines, on the other hand, the quantity of bosh gas can be lowered, by blowing oxygen into the furnace through the tuyere. This can lower the top gas temperature and thus suppress a rise in the top gas temperature. According to this invention, at the chromium content of over 40%, the operation can be performed without the preheating gas, but at the chromium content of under 40% it is preferable that the top gas temperature be prevented from being markedly lowered by blowing the preheating gas. According to this invention not only the oxygen but also the temperature control gas can be blown into the furnace through the tuyere to control the aforementioned flame temperature.

Figure 6:
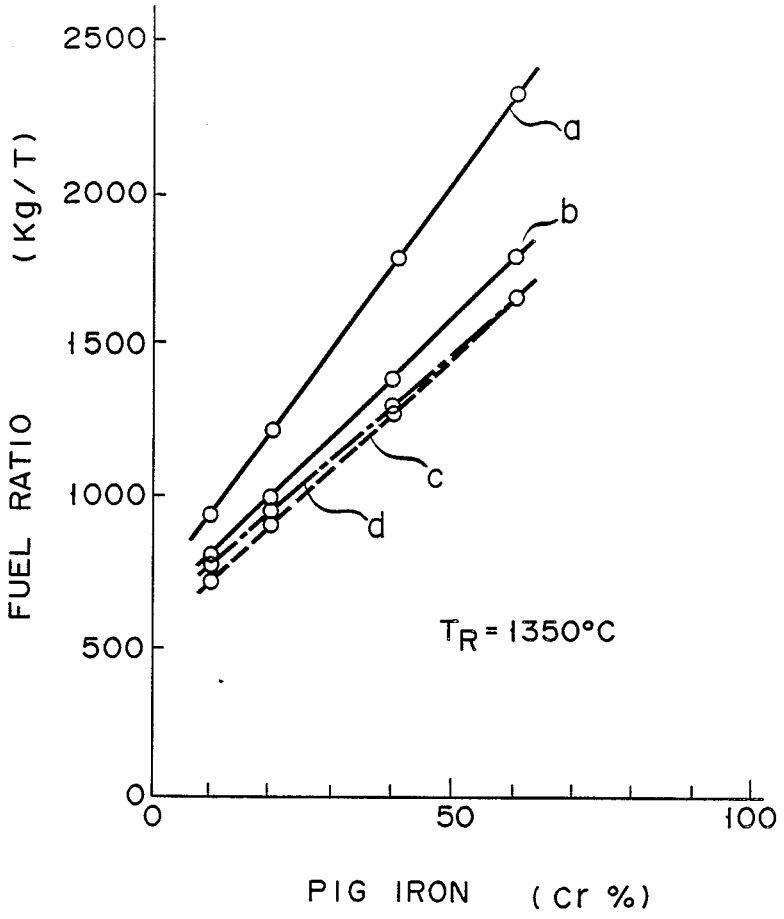
FIG. 6 is a view showing a relation between the content of chromium in pig iron and a fuel ratio.

FIG. 6 shows a Cr content level to fuel ratio relation when the top gas and steam as the tuyere nose flame temperature control agent are used in the oxygen blast operation, noting that:

(a) The tuyere nose flame temperature $T_f$ is increased to 2600° C. while using steam;

(b) The temperature $T_f$ is increased to 2600° C. while blowing the pulverized coal and top gas into the furnace through the tuyere;

(c) The temperature $T_f$ is increased to 2900° C. under the same condition as in (b); and (d) The temperature $T_f$ is increased to 2600° C. while only the top gas as the temperature control agent is blown into the furnace through the tuyere.

Where the steam is used as the tuyere nose flame temperature control agent, a greater absorption of heat is involved, resulting in a higher fuel ratio FR. It is to be noted that the atmospheric air can be used to control the tuyere nose flame temperature.

Table 3 shows an example of unit consumption per ton of molten metal when the top gas is used for the tuyere nose flame temperature control in the oxygen blast operation according to this invention. At Cr=40 to 60%, $CO_2$ in the top gas is low on the order of 4 to 9% and can be used as synthetic chemical feed gas either directly or after it has been processed lightly.

TABLE 3-1

| Chromium content | Cr 20% | | Cr 40% | | Cr 60% | |
|---|---|---|---|---|---|---|
| Flame temperature ($T_f$) | 2600° C. | 2900 | 2600 | 2900 | 2600 | 2900 |
| Chromium ore | 564 Kg | 564 | 1126 | 1126 | 1690 | 1690 |
| Iron ore | 1115 Kg | 1115 | 662 | 662 | 209 | 209 |
| Limestone | 0 Kg | 0 | 131 | 128 | 351 | 348 |
| Silica stone | 61 Kg | 64 | 128 | 131 | 292 | 297 |
| Carbon contained in cold bond pellets | 150 Kg | 150 | 225 | 225 | 300 | 300 |
| Coke lump | 340 Kg | 250 | 405 | 295 | 520 | 380 |
| Total | 490 Kg | 400 | 630 | 520 | 820 | 680 |
| PC | 500 Kg | 500 | 750 | 750 | 950 | 950 |
| $O_2$ | 547 $Nm^3$ | 488 | 787 | 709 | 1028 | 925 |
| Top gas circulated | 312 $Nm^3$ | 146 | 591 | 316 | 891 | 488 |

TABLE 3-2

| Chromium content | Cr 20% | | Cr 40% | | Cr 60% | |
|---|---|---|---|---|---|---|
| Flame temperature ($T_f$) | 2600° C. | 2900 | 2600 | 2900 | 2600 | 2900 |
| Preheating gas circulated | 66 $Nm^3$ | 207 | 0 | 0 | 0 | 0 |
| Top gas CO | 68.5% | 61.5 | 79.0 | 77.2 | 83.6 | 52.5 |
| $CO_2$ | 17.7% | 23.9 | 8.0 | 9.3 | 3.9 | 4.5 |
| $H_2$ | 7.5% | 6.6 | 9.5 | 9.5 | 10.5 | 10.6 |
| $H_2O$ | 5.5% | 7.3 | 2.8 | 3.3 | 1.4 | 1.7 |
| $N_2$ | 0.7% | 0.7 | 0.7 | 0.7 | 0.7 | 0.7 |
| calories | $3.6 \times 10^6$ Kcal | 3.0 | 6.1 | 5.5 | 8.4 | 7.7 |
| amount | 1593 $Nm^3$ | 1461 | 2316 | 2122 | 3018 | 2769 |
| temperature | 100° C. | 100 | 259 | 106 | 346 | 198 |

Figure 7:
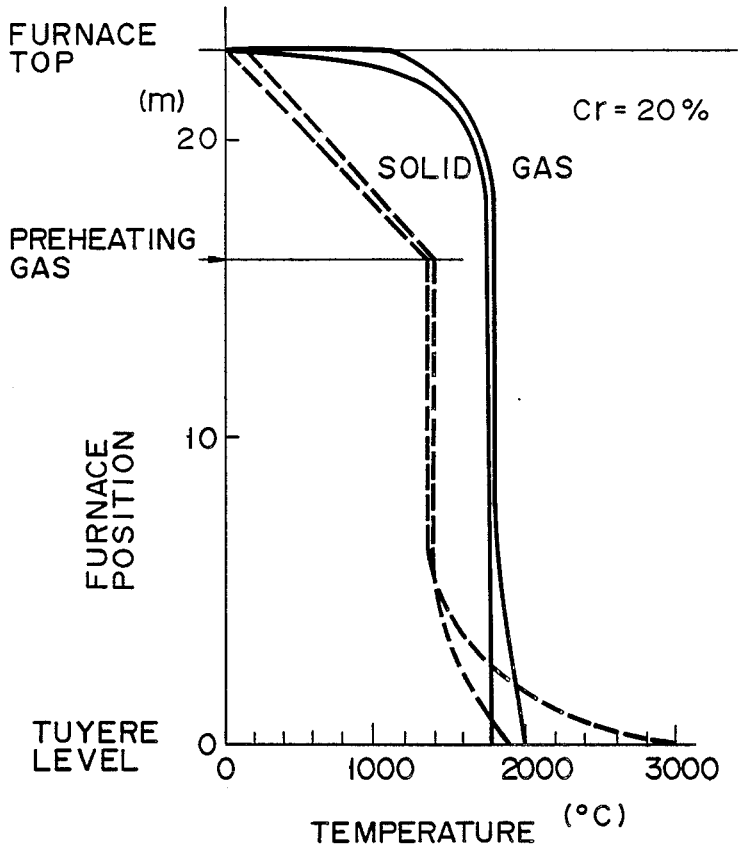
FIG. 7 is a view showing an estimated intrafurnace temperature distribution.

FIG. 7 is a graph showing a temperature distribution in the blast furnace. The solid lines in FIG. 7 show the hot air blast operation at $T_f$=2000° C. and $T_R$=1650° C., noting that $T_R$ represents the reduction reaction initiation temperature. The broken lines in FIG. 7 show the oxygen blast operation at $T_f$=2900° C. and $T_R$=1350° C. In the oxygen blast operation using the cold bond pellets contained carbon material as a feed material a heat load on the furnace body and on the furnace top is alleviated. Since the inner atmosphere of the blast furnace is highly reductive in nature, the reduction reaction of FeO will be completed rapidly so that the corrosion of the refractories on the furnace wall due to the temperature and chemical attack is alleviated.

The following is the example of the furnace operation during the manufacture of cold bond pellets contained carbon material according to this invention.

A powdered chromium ore, powdered coke, cement and powdered silica stone each have chemical constituents and particle distribution as respectively shown in Tables 4 and 5. They were mixed in accordance with a ratio as shown in Table 6. The mixed mass was pelletized by a 4 m-diameter disc pelletizer, and either rapidly cured (1) or allowed to be cured (2) to prepare cold bond pellets contained carbon material.

TABLE 4

| | $Cr_2O_3$ (%) | TFe (%) | FeO (%) | $SiO_2$ (%) | $Al_2O_3$ (%) | MgO (%) | CaO (%) | P (%) | S (%) | FC (%) | V.M. (%) | Ash (%) |
|---|---|---|---|---|---|---|---|---|---|---|---|---|
| Powdered Cr ore | 45.7 | | 19.6 | 6.5 | 11.3 | 14.1 | | 0.003 | 0.011 | | | |
| Powdered coke | | | 0.57 | 6.38 | 3.18 | 0.15 | 0.36 | 0.032 | 0.59 | 88.2 | 0.3 | 11.5 |
| Cement | | | | 21.32 | 4.92 | 2.81 | 62.86 | | | | | |
| Powdered silica | | 0.75 | 0.33 | 95.55 | 1.53 | 0.63 | 0.09 | 0.007 | 0.013 | | | |

TABLE 4-continued

| | $Cr_2O_3$ (%) | TFe (%) | FeO (%) | $SiO_2$ (%) | $Al_2O_3$ (%) | MgO (%) | CaO (%) | P (%) | S (%) | FC (%) | V.M. (%) | Ash (%) |
|---|---|---|---|---|---|---|---|---|---|---|---|---|
| stone | | | | | | | | | | | | |

TABLE 5

| Particle size (μ) | 500–1000 | 250–500 | 125–250 | 74–125 | 44–74 | –44 |
|---|---|---|---|---|---|---|
| Powdered Cr ore (%) | 0.09 | 0.25 | 2.96 | 9.27 | 7.88 | 79.55 |
| Powdered coke (%) | | 0.08 | 0.49 | 5.08 | 10.57 | 83.78 |
| Cement (%) | | | 0.19 | 0.35 | 2.47 | 96.99 |
| Powdered silica stone (%) | 0.11 | 0.17 | 0.38 | 2.99 | 9.05 | 87.30 |

TABLE 6

| | | Control | Example |
|---|---|---|---|
| Constituents to be mixed | Powdered Cr ore (%) | 70.20 | 60.68 |
| | Powdered coke (%) | 14.80 | 12.80 |
| | Cement (%) | 15.00 | 15.00 |
| | Powdered silica stone (%) | | 11.52 |

The curing step (1) was conducted by a pre-drying (90° C., 30 minutes), steam treating (100° C., 9 hours under a saturated steam) and post-drying process (250° C., 1 hour).

*The characteristics of pellets so prepared by the curing step (1) are shown in Table 7 below.

TABLE 7

| | | Control | Example |
|---|---|---|---|
| Rapid curing | Compressive strength (Kg/p) | 138.40 | 141.01 |
| | Shatter strength (−3 mm %) | 0.10 | 0.30 |
| | Softening on load (reduction) | ○ | ◎ |
| | Softening Meltability | Δ | ◎ |

In Example, the pellets obtained were excellent in compressive strength, shattered strength and softening property on load in comparison with Control never containing any pulverized silica stone. The shatter strength is shown as a ratio of pellet particles of below 3 mm which were sieved after the pellets were dropped 10 times from a height of 2 m. The compressive strength is shown as a load which is necessary for the single particle to be collapsed.

In the curing step (2), the pellets were allowed to be cured in 1, 2, 3 and 4 weeks in the outer atmosphere and the respective compressive strength was measured.

TABLE 8

| | | Control | Example |
|---|---|---|---|
| As-cured | Compressive strength after 1 week (Kg/p) | 62.38 | 76.41 |
| | Compressive strength after 2 weeks (Kg/p) | 88.68 | 86.59 |
| | Compressive strength after 3 weeks (Kg/p) | 94.91 | 97.78 |
| | Compressive strength after 4 weeks (Kg/p) | 113.79 | 125.02 |

The compressive strength is increased with an increasing curing period and, therefore, the pellets can be used for the blast furnace after lapse of about 4 weeks. The Example shows that a high compressive strength was able to be obtained also in the case of the rapid curing, in comparison with Control.

The following is Example, i.e., a method for manufacturing a chromium-bearing pig iron according to this invention.

A blast furnace used was 0.95 m in a hearth diameter and 3.9 $m^3$ in an inner volume. As charge materials use was made of cold bond pellets contained carbon material, sintered ore, silica stone and coke, which were charged to attain an intended chromium content level. The silica stone was charged so as for the $Al_2O_3$-MgO content in slag to be 25% or less. Pure oxygen and coal were blown into the furnace, while utilizing steam as the flame temperature control agent. A combustion gas of 1100° C. was blown as a preheating gas into the middle of the furnace. The unit consumption is shown in more detail in Table 9 below and the results of the operation are shown in Table 10 below.

TABLE 9

| Intended Cr content level (%) | | 5 | | 10 | | 15 | | 20 | |
|---|---|---|---|---|---|---|---|---|---|
| Charging material | Cold bond pellets | 67 Kg/H | 268 Kg/T | 128 | 545 | 203 | 812 | 257 | 1089 |
| | Sintered ore | 375 | 1500 | 323 | 1374 | 310 | 1240 | 260 | 1102 |
| | Silica stone | 28 | 112 | 38 | 162 | 58 | 232 | 73 | 309 |
| | Coke | 350 | 1400 | 375 | 1596 | 400 | 1600 | 425 | 1800 |
| | C in cold bond pellets | 10 | 40 | 19 | 81 | 31 | 124 | 39 | 165 |
| Blowing | $O_2$ | 240 $Nm^3/H$ | | 260 | | 260 | | 288 | |
| | Steam | 69 Kg/H | | 70 | | 70 | | 83 | |
| | Pulverized coal | 80 | 320 | 80 | 340 | 80 | 320 | 80 | 339 |
| | $T_f$ | 2600° C. | | 2700 | | 2700 | | 2700 | |
| Preheating gas | Temperature | 1100° C. | | 1100 | | 1100 | | 1100 | |
| | Quantity | 250 $Nm^3/H$ | | 250 | | 250 | | 250 | |

TABLE 10-1

| Intended Cr content level (%) | | 5 | | 10 | | 15 | | 20 | |
|---|---|---|---|---|---|---|---|---|---|
| Fuel ratio | | 1760 Kg/T | | 2017 | | 2044 | | 2304 | |
| Tapping | calculated | 250 Kg/H | 1000 Kg/T | 235 | 1000 | 250 | 1000 | 236 | 1000 |
| quantity | actual | 274 | | 215 | | 252 | | 231 | |
| Stag-off | calculated | 147 | 588 | 182 | 774 | 237 | 948 | 272 | 1153 |
| quantity | actual | 129 | | 165 | | 178 | | 224 | |
| Quantity of dust | | 20 | 80 | 34 | 145 | 58 | 232 | 64 | 271 |
| Tapping temp. | | 1432° C. | | 1478 | | 1487 | | 1442 | |
| Slag-temp | | 1464° C. | | 1527 | | 1487 | | 1500 | |

TABLE 10-2

| | | | | | |
|---|---|---|---|---|---|
| Metal composition | C | 3.81% | 3.74 | 3.63 | 3.25 |
| | Si | 2.84 | 5.26 | 5.48 | 6.80 |
| | Cr | 4.68 | 9.86 | 15.46 | 19.42 |
| | P | 0.178 | 0.216 | 0.244 | 0.241 |
| | S | 0.112 | 0.091 | 0.107 | 0.153 |

TABLE 10-3

| | | | | | |
|---|---|---|---|---|---|
| Slag composition | MgO | 7.02% | 7.68 | 7.60 | 6.87 |
| | $Al_2O_3$ | 14.86 | 16.42 | 14.54 | 16.58 |
| | $SiO_2$ | 35.36 | 35.30 | 37.47 | 38.38 |
| | CaO | 31.88 | 29.43 | 27.25 | 26.83 |
| | $Cr_2O_3$ | 0.0476 | 0.181 | 0.276 | 0.295 |
| | $P_2O_5$ | 0.015 | 0.016 | 0.017 | 0.013 |
| | S | 1.414 | 1.576 | 1.676 | 1.090 |

TABLE 10-4

| Top gas temp. (°C.) | | 200 | 200 | 230 | 250 |
|---|---|---|---|---|---|
| Top gas composition | CO | 69.7% | 73.8 | 75.3 | 75.9 |
| | $CO_2$ | 15.9 | 12.5 | 10.2 | 10.0 |
| | $H_2$ | 14.2 | 13.7 | 14.7 | 14.1 |
| | $N_2$ | Tr. | Tr. | Tr. | Tr. |

It has been confirmed that pulverized coke blowing into the furnace through the tuyere was completely burned. A favorable situation prevailed within the blast furnace with no occurrence of any slip, blow-through and hanging. A smooth slag-out was also observed upon tapping.

The content of $Cr_2O_3$ in the slag is less than 0.3%. From this it may be concluded that the reduction process of the chromium ore was favorably conducted.

The top gas temperature was somewhat raised with an increasing chromium concentration level, but no unfavorable furnace operation arised at below 300° C. As the top gas constituents, CO was over 65% with $N_2$ nearly at zero. It has been confirmed that the aforementioned top gas finds a wider availability as a synthetic chemical feed gas.

What is claimed is:

1. A method for manufacturing a chromium-bearing pig iron, comprising:

preparing cold pellets from powdered chromium ore, powdered coke and flux materials;

introducing a charge of said cold pellets together with iron ore and coke lumps into a blast furnace to form a burden in the blast furnace;

blowing a preheating gas into said burden at the middle level of said blast furnace to preheat said burden; and blowing a gas containing more than 50% oxygen, into the blast furnace, through a tuyere therein thereby manufacturing chromium bearing pig iron from said charge including said cold pellets.

2. The method according to claim 1, wherein said gas containing more than 50% oxygen includes 95 to 100% oxygen.

3. The method according to claim 2, wherein said gas includes pure oxygen.

4. The method according to claim 1, further comprising a step of blowing a temperature control agent at a nose of the tuyere, into the blast furnace, through the tuyere.

5. The method according to claim 4, wherein said temperature control agent includes at least one selected from the group consisting of circulated top gas, steam, water, $CO_2$ and cold air.

6. The method according to claim 4, wherein said step of blowing a temperature control agent includes controlling a tuyere nose flame temperature from 2000° to 2900° C.

7. The method according to claim 6, wherein said tuyere nose flame temperature is controlled from 2400° to 2800° C.

8. The method according to claim 1, wherein said preheating gas is at a temperature of from 1000° to 1600° C.

9. The method according to claim 1, further comprising a step of blowing fuel, through the tuyere, into the blast furnace.

10. The method according claim 9, wherein said fuel includes at least one selected from the group consisting of powdered coal, powdered coke, heavy oil and tar oil.

11. The method according to claim 1, wherein said cold pellets are prepared by the steps of:

mixing and pelletizing powdered chromium ore and powdered coke to prepare green pellets; and curing said green pellets.

12. The method according to claim 11, wherein said step of mixing and pelletizing includes mixing and pelletizing, in addition to said powdered chromium ore and powdered coke, a silica source to prepare said green pellets said cured pellets being capable of being reduced 90% at 1350° C. in said furnace.

13. The method according to claim 11, wherein said step of curing said green pellets includes allowing said green pellets to be cured in an air atmosphere.

14. The method according to claim 11, wherein said step of curing said green pellets includes rapidly curing said green pellets by a pre-drying, steam treating and post-drying process.

15. The method according to claim 1, wherein said step of introducing said cold pellets, said iron ore and said coke includes introducing a flux which causes a slag formed in the blast furnace to contain $Al_2O_3$-MgO of 30% or less.

16. The method according to claim 1, wherein said gas containing more than 50% of oxygen is blown at ambient temperature.

17. The method for producing chromium-bearing pig iron in a blast furnace which comprises:

preparing bonded pellets from powdered chromium ore, powdered coke and flux materials;

introducing into a blast furnace a cold charge of said bonded pellets together with iron ore and coke lumps to form a burden in said blast furnace, said charge being proportioned in terms of Cr and Fe to yield a chromium-bearing pig iron;

blowing a preheating gas at a temperature of from 1000° to 1600° C. into said burden at the middle level of said blast furnace to preheat said burden; and blowing a gas containing more than 50% oxygen through the tuyeres of said blast furnace at a controlled flame temperature between 2000° and 2900° C., to produce chromium-bearing pig iron while yielding a furnace top gas low in nitrogen.

* * * * *